US010208481B2

(12) United States Patent
Siegfried

(10) Patent No.: US 10,208,481 B2
(45) Date of Patent: Feb. 19, 2019

(54) STRAIGHT LINE SHINGLE

(71) Applicant: Todd A. Siegfried, New Bloomfield, PA (US)

(72) Inventor: Todd A. Siegfried, New Bloomfield, PA (US)

( * ) Notice: Subject to any disclaimer, the term of this patent is extended or adjusted under 35 U.S.C. 154(b) by 0 days.

(21) Appl. No.: 15/168,052

(22) Filed: May 29, 2016

(65) Prior Publication Data

US 2018/0258647 A1 Sep. 13, 2018

(51) Int. Cl.
*E04D 15/02* (2006.01)

(52) U.S. Cl.
CPC ..... *E04D 15/025* (2013.01)

(58) Field of Classification Search
CPC ..... E04D 15/025; E04D 15/02; E04D 15/04; E04F 21/1855; E04F 13/0864
USPC ..... 33/648, 649, 646, 647
See application file for complete search history.

(56) References Cited

U.S. PATENT DOCUMENTS 1,380,485 A * 6/1921 Langeberg ..... E04D 15/025 33/649
2,426,825 A * 9/1947 Geary ..... E04G 3/26 182/147
2,814,533 A * 11/1957 Van Horn ..... E04G 3/26 182/129
3,245,192 A * 4/1966 Hilson ..... E04D 15/04 156/574
3,292,734 A * 12/1966 Swanberg ..... E04G 3/26 182/150
3,842,934 A * 10/1974 Bartlett ..... E04G 3/26 182/37
4,056,889 A * 11/1977 Barnett, III ..... E04D 15/04 33/649
4,110,911 A * 9/1978 Sucheck ..... G01B 5/16 33/483
4,785,606 A * 11/1988 Burton ..... E04G 3/26 182/45
5,018,279 A * 5/1991 Williams ..... E04D 15/025 33/648
5,205,103 A * 4/1993 Burton ..... E04D 15/02 182/45
D335,461 S * 5/1993 Horsley, Jr. ..... D10/64
5,311,670 A * 5/1994 Tomoiaga ..... E04D 15/025 33/648
5,908,083 A * 6/1999 Hamilton ..... E04G 3/26 182/206
5,918,439 A * 7/1999 Metzer ..... E04D 1/26 33/649

(Continued)

*Primary Examiner* — Paola Agudelo
(74) *Attorney, Agent, or Firm* — Furr Law Firm; Jeffrey Furr, Esq.

(57) ABSTRACT

The present invention is an apparatus for applying shingles onto a roof of a structure. The present invention is a Straight line shingle apparatus to which when applied to an already prepared roof top, will be all the pre set lines and margins required to applying a perfectly square and level shingle roof according to the shingle specifications. There are three main parts to this apparatus, two vertical rods fixed on the roof deck, a vertical rod set up, which rides in bearings affixed to the horizontal housings, which produces a very easy sliding motion and a rack, positioned at an even line spacing from the bearings to let a user lay shingles into an extended row of shingles. Once shingles are positioned, many shingles may be nailed at once.

16 Claims, 6 Drawing Sheets

(56) References Cited

U.S. PATENT DOCUMENTS

| | | | | |
|---|---|---|---|---|
| 6,189,227 | B1 * | 2/2001 | Siegfried | E04D 1/26 33/613 |
| 2014/0196298 | A1 * | 7/2014 | George | E04D 15/025 33/648 |

* cited by examiner

STRAIGHT LINE SHINGLE

CROSS-REFERENCES TO RELATED APPLICATIONS (IF ANY)

None

BACKGROUND

1. Field of the Invention

The invention relates to an apparatus for placing shingles onto a roof in an orderly manner. In particular, the invention relates to an apparatus that allows for quick and accurate placement of shingles onto a roof of a structure, such as a house.

2. Description of Prior Art

During construction of a house or other type of structure, once the frame of the house has been constructed, the roof can then be installed. Typically, this involves the placement of shingles onto the roof frame, in a standard manner so as to allow for rain or other precipitation to flow off of the roof and onto a drainage system (i.e., drain spouts on the side of the house). Using conventional methods, the placement of shingles onto the roof is a time-consuming and error-prone effort, in which typically a group of persons work together to first place the shingles onto the roof in rows, and then staple the shingles in place. When one row is complete, the workers move onto a next row to continue the process.

For standard roofs, the rows are placed 5" apart from each other, with the first row placed approximately 11½" from the edge of the roof. After the placement of the first row, shingles of the second row are shifted 6" with respect to the shingles of the first row, shingles of the third row are shifted 6" with respect to the shingles of the second row (and are thus in alignment with the shingles of the first row), and so on. By this arrangement, the shingles overlap each other, as well as having a lattice-like appearance when placed onto the roof.

There are several conventional apparatuses that have been developed to assist roofers in the proper placement of shingles onto a residential or commercial structure. One such apparatus is disclosed by L. Barnett III, in a patent entitled "Strip Shingle Alignment Fixtures", U.S. Pat. No. 4,056,889. Barnett's apparatus allows for the alignment of strip shingles for roofing and siding, in which an elongated alignment guide is provided for supporting the lower edges of the shingles to be laid on the roof. The alignment guide includes several sections, some equal in length to two standard strip shingles, and others equal in length to one standard strip shingle.

Another such conventional shingle application apparatus is disclosed by R. Sucheck, in a patent entitled "Shingle Gage", U.S. Pat. No. 4,110,911. Sucheck discloses a shingle gage that allows for alignment of a second row of shingles onto a first row of shingles that have been fixed to a roof of a structure. The shingle gage includes a first member having a first alignment surface which abuts one longitudinal edge of the fixed row of shingles, and a second member attached to the first member and which includes a second alignment surface adapted to abut against one longitudinal edge of the second row of shingles.

U.S. Pat. No. Des. 335,461, issued to H. Horsley, Jr., discloses a design of a straight edge for aligning a shingle onto a roof.

U.S. Pat. No. 5,018,279, issued to C. Williams, discloses a strip shingle alignment tool. The tool is used to position square tab shingles on a roof surface in alignment with shingle strips already fastened to the roof. The tool includes a long straight shingle positioning plate having a base flange extending a right angles up away from the base flange. The tool also includes two clamps that extend back from the base flange, with each clamp having a upper jaw mounted to the positioning plate and a lower jaw pivoted to the upper jaw.

U.S. Pat. No. 5,311,670, issued to I. Tomoiaga, discloses a shingle alignment tool for use by a single installer for aligning a row of shingles to be fastened to a roof. The alignment tool includes a pair of brackets that fit snugly against the lower edge of an already-fastened shingle. The tool also includes an upper edge that allows the shingles to be fastened to be quickly placed there against for proper alignment.

With each of the conventional devices described above, there exist several problems in that these devices need to be aligned with an already-fastened row of shingles to be able to work properly.

Also, some of these devices do not allow for the application of an entire row of shingles, but only allow for a portion of a row to be installed. Once the portion of the row has been installed, the devices must be dismounted and/or moved to another location to continue the placement of the next row of shingles onto the roof.

U.S. Pat. No. 6,189,227, issued to Siegfried, discloses an apparatus for applying shingles onto a roof of a structure. The apparatus includes a first and second retractable/extendable rail, with the first and second rails being positioned to ends of a roof in a parallel relationship to each other.

There is still room for improvement in the art.

SUMMARY OF THE INVENTION

The present invention is a Straight line shingle apparatus to which when applied to an already prepared roof top, will be all the pre set lines and margins required to applying a perfectly square and level shingle roof according to the shingle specifications. There are three main parts to this apparatus.

First, there are two vertical rods fixed on the roof deck. These rods carry roller bearings and housings.

Second, there is a vertical rod set up, which rides in bearings affixed to the horizontal housings, which produces a very easy sliding motion. There are also bearing houses for the vertical rod to set motion to allow apparatus to slide easily. The vertical houses play a role in carrying the third part.

The third part is a rack, positioned at an even line spacing from the bearings to let a user lay shingles into an extended row of shingles. Once shingles are positioned, many shingles may be nailed at once.

The current invention is more efficient, effective, accurate and functional than the current art.

BRIEF DESCRIPTION OF THE DRAWINGS

Without restricting the full scope of this invention, the preferred form of this invention is illustrated in the following drawings.

DESCRIPTION OF THE PREFERRED EMBODIMENT

There are a number of significant design features and improvements incorporated within the invention.

Figure 1:
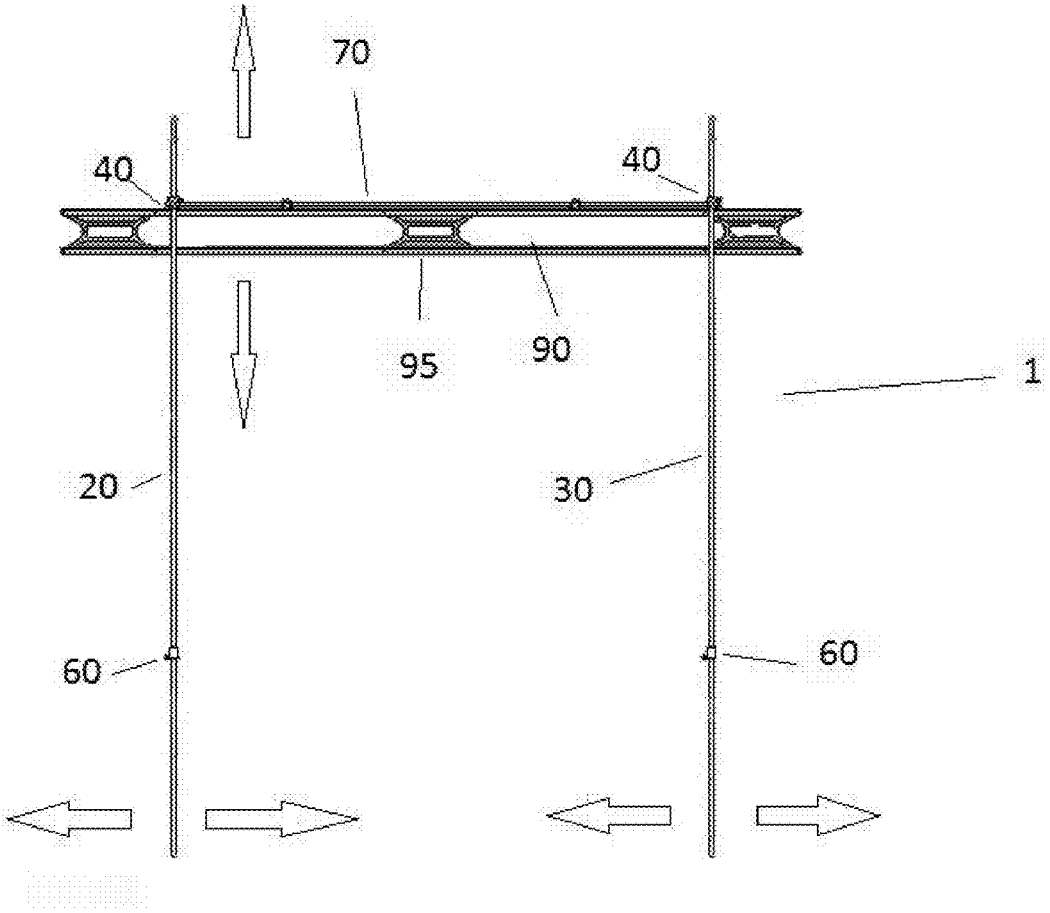
FIG. 1 shows the current invention and its main components.
Figure 2:
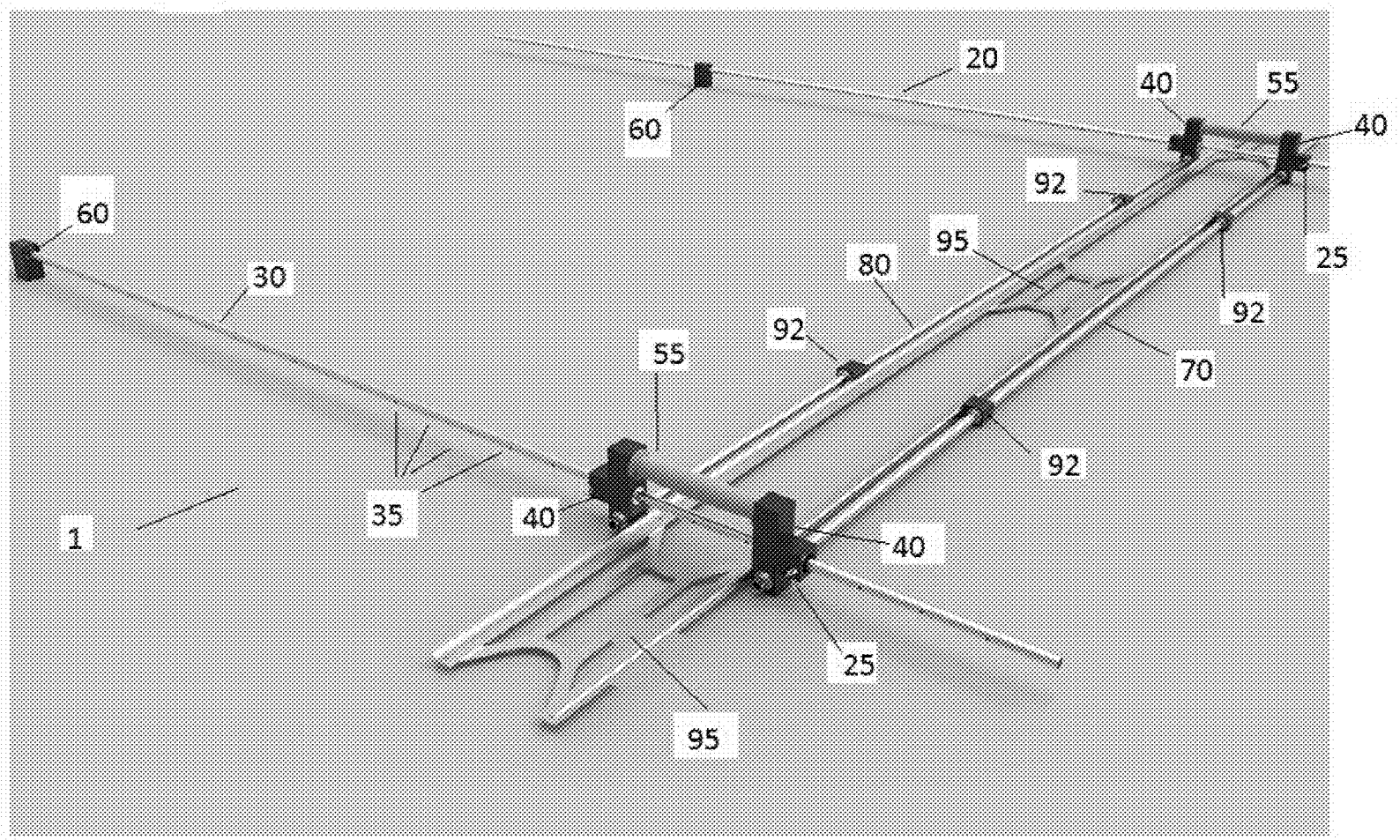
FIG. 2 displays a perspective view of the current invention.
Figure 3:
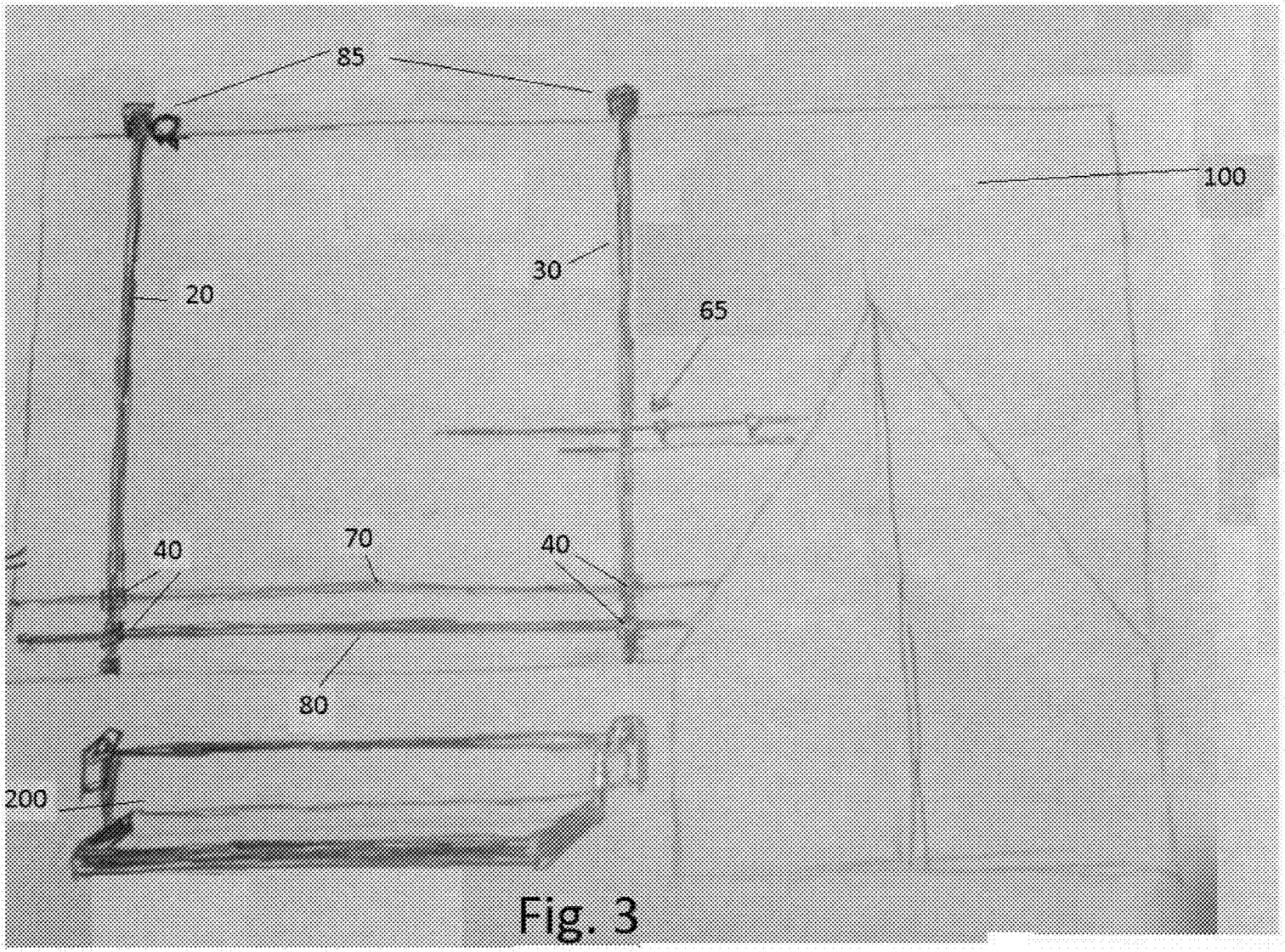
FIG. 3 shows the assembly being used on a roof.

The present invention is a Straight line shingle apparatus 1 as shown in FIGS. 1 and 2. It is applied to an already prepared roof top 100 and will provide all the pre set lines and margins required to applying a perfectly square and level shingle roof according to the shingle specifications as shown in FIG. 3.

There are three main parts to this apparatus 1.

First, there are two vertical rods fixed on the roof deck, a left vertical rod 20 and a right vertical rod 30. These rods (20, 30) carry roller bearings and housings. They are aligned perpendicular to the roof 100.

Second, there is a vertical rod set up which are two dual pillow blocks 40. The dual pillow blocks 40 have openings that the rods 20, 30 slide through as well as an opening for horizontal rods 70, 80 in which the rods rides in bearings affixed to the horizontal and vertical housings producing a very easy sliding motion.

The third part is a rack or rail assembly 50, positioned at an even line spacing from the bearings to let a user lay shingles into an extended row of shingles. Once shingles are positioned, many shingles may be nailed at once. The rail assembly 50 is attached to the horizontal rods 70, 80.

Figure 4:
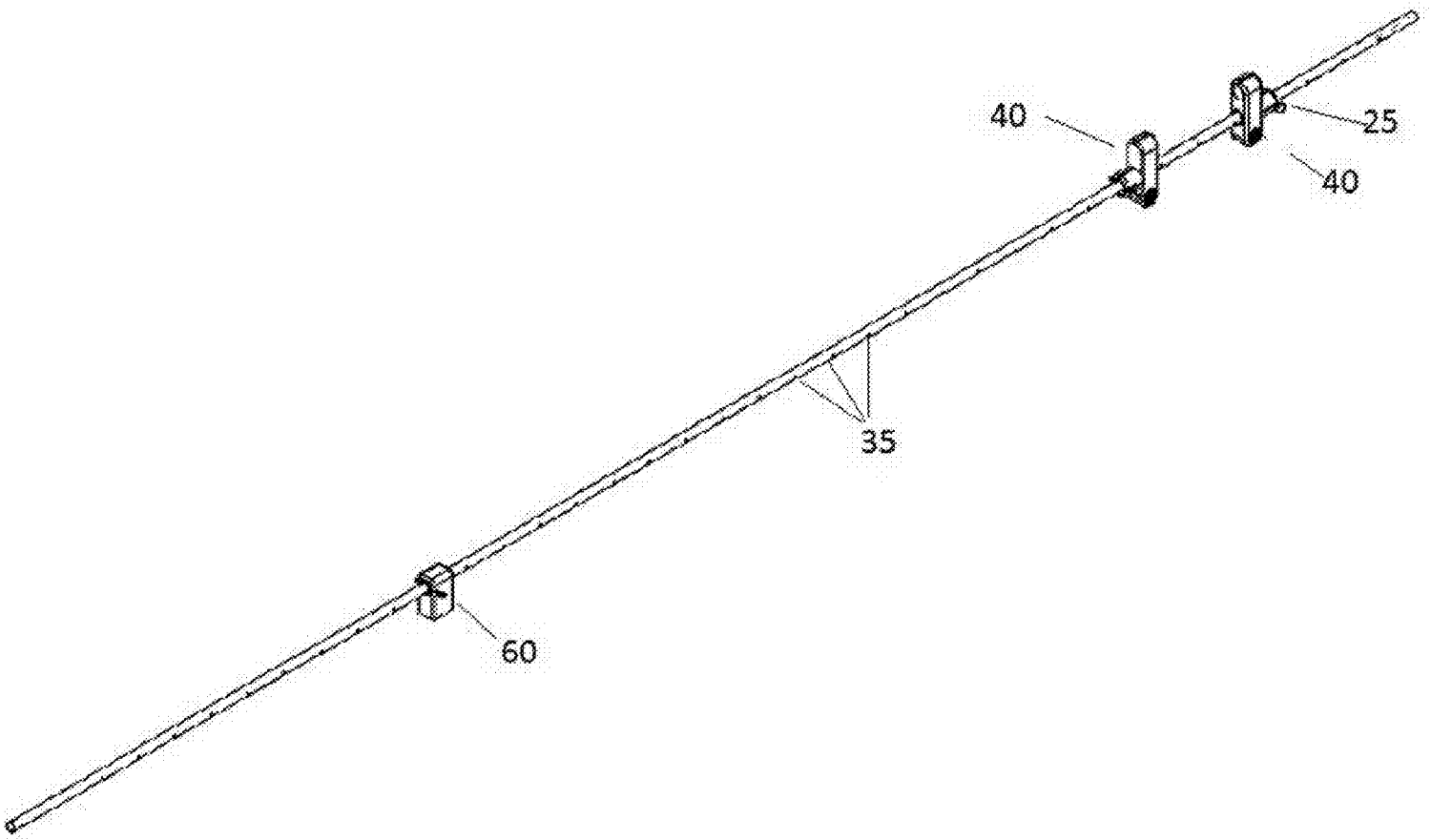
FIG. 4 displays one of the vertical rods.

In the present invention, the left and right rods 20, 30, horizontal rods 70, 80 and the rail assembly 90 are constructed from a lightweight material, such as aluminum or plastic. As shown on FIG. 4, the rods 20, 30, has a bearing base assembly 60 that can moved along the rods 20, 30. The bearing base assembly 60 supports the rods 20, 30 on the roof 100.

The assembly 1 has two horizontal rods, a top rod 70 and a bottom rod 80. These horizontal rods are perpendicular to the vertical rods and are parallel to each other.

Between the two horizontal rods is the rail assembly 90. The rail assembly 90 has multiple shingle brackets 95 that connect the top and bottom of the rail assembly 90 providing stability. The rail assembly 90 is connected to the horizontal rods 70, 80 through brackets 92 which have openings through which the horizontal rods run through. The rail assembly 90 can move up and down the vertical rods 20, 30 while the vertical rods 20, 30 move left and right along the horizontal rods 70, 80.

Figure 5:
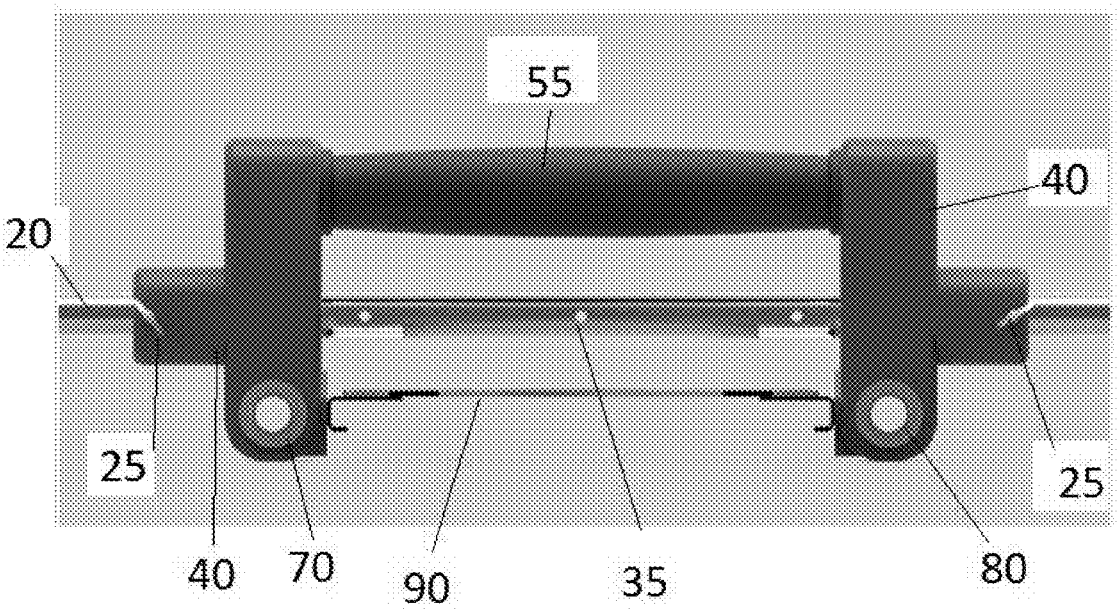
FIG. 5 displays the handle and dual pillow.
Figure 6:
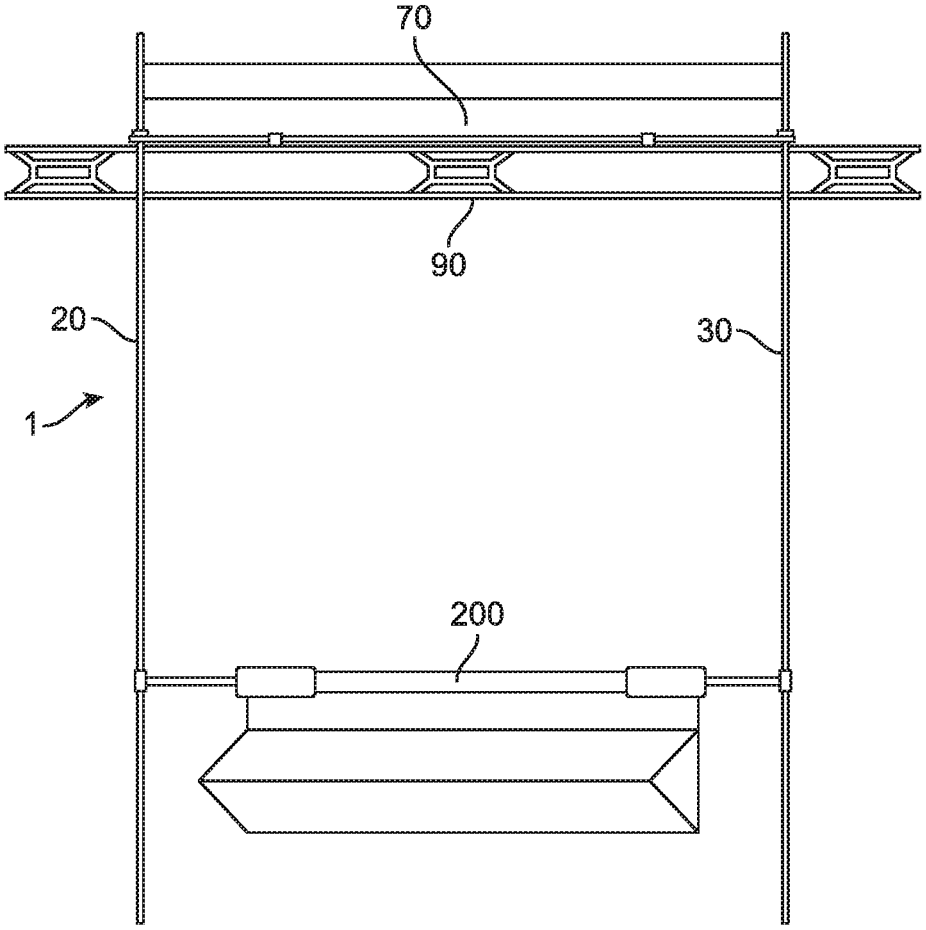
FIG. 6 displays an alternative embodiment with a work plank.

The assembly 1 can have handles 55 in increase the ease of using the assembly 1 and moving vertical rods 20, 30 left and right and the rail assembly 90 up and down. In the preferred embodiment, the handles 55 are connected to the two dual pillow blocks 40 by having a handle bar connecting to the top and bottom dual pillow blocks as shown in FIG. 5. The handles 55 can be covered in soft grip non-heat transference material such as one made out of rubber.

The dual pillow blocks 40 are held in place through a locking means. In the preferred embodiment, the vertical rods 20, 30 will have positioning slots 35 positioned at set intervals, placed 5" apart in the preferred embodiment, along their sides into which a locking pin 25 is inserted to lock the dual pillow blocks 40 in place thereby locking the assembly 1 into its desired position. Any other locking means can be used such as hinges, latches or the use of pneumatic pressure, A valley cue 65, is designed to hook over the vertical bearing rods 20, 30. The Shingle ledge is set 5 inches higher then Shingle ledge of the apparatus 1. This allows the valley cue 60 to pre fasten valley shingles, then the apparatus 1 can butt to the upper course which are fastened.

In the preferred embodiment, the vertical rods 20, 30 will have mounting brackets 85 at the top end of the rods, as shown in FIG. 3. These mounting brackets 85 connect and secure the assembly 1 to the top of the roof 100. They can be designed as hooks that hook over the edge of the roof 100 or other connecting means such as screws or nails.

In an alternative embodiment, the assembly 1 can have a work plank 200 that is connected to the left rod 20 and right rod 40 and is a bench to stand on, designed to follow the apparatus 1 up the roof 100 as shown in FIG. 5. The work plank 200 is locked into place using the same locking means as the rail assembly 90.

Operation

The attachment of shingles onto a roof will now be explained in detail. First, the roofer lays out the apparatus 1 onto a side of the roof, similar to the layout shown in FIG. 3. Once the rods have be moved as to cover the dimensions of the roof, the rods are locked into place, such as by any conventional means. For example, the rails may be configured such that a simple twisting of the parts of each rail may be utilized to lock each rail in place or a locking pen 25 can be inserted into a locking hole 35 in the rod 20, 30. The handle 55 can be used to place the rods and rail assembly 90 in their proper location. The assembly 1 is then secured to the roof 100.

Once rail assembly 90 is placed onto the respective lowermost slots of the first and second rods 20, 30, so as to allow for proper placement of the first row of shingles onto the roof. Once shingles are positioned, many shingles may be nailed at once.

Referring now to FIG. 3, which respectively show a plan view of the assembly 1 being used on a roof 100. A portion of the bottom end fits under a shingle that is placed on the apparatus 1. The assembly is preferably configured to have about a 3" long top portion that is substantially parallel to the plane of the roof, a ½" long side portion that is substantially perpendicular to the plane of the roof, and about a ¼" lower portion that rests on the roof. In the first configuration, the lower portion is configured with a slightly curved attached to the roof, such as by stapling them using a staple gun. Once shingles are positioned, many shingles may be nailed at once.

The rail assembly 90 can be moved up or down on the vertical rods 20, 30 as the shingle rows are completed. If the work plank 200 is used it can also be moved up or down on the vertical rods 20, 30 as needed.

Advantages

The current invention is the only product that can guarantee razor sharp precision with the shingles, in the least amount of time. It features an easy to use, lightweight, compact, and durable system allowing for the best finish on the house. The current invention allows for the following: truly straight shingle lines with ease, the ability to finish a roof in almost half the time and durable high quality materials and portable Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An apparatus for placement of shingles onto a roof, comprising:

a left vertical rod, a right vertical rod, a top horizontal rod and a bottom horizontal rod, wherein the top and bottom horizontal rods are spaced apart and parallel to each other, and wherein the top and bottom horizontal rods are perpendicular to the left and right vertical rods;

a plurality of dual pillow blocks with openings for the left vertical rod and the right vertical rod which the vertical rods slide through said openings;

where the dual pillow blocks have a locking means to lock the rods in place;

a rail assembly with a top and bottom with a plurality of shingle brackets that connect to the top and the bottom of the rail assembly where the rail assembly is attached to and is between the horizontal rods; and openings for the horizontal rods in the shingle brackets which the horizontal rods run through.

2. The apparatus as recited in claim 1 where said locking means is a locking pin.

3. The apparatus as recited in claim 1 each vertical rod has a plurality of bearing base assemblies that can moved along said rods.

4. The apparatus as recited in claim 1 where the horizontal and vertical rods ride in bearings affixed to the horizontal and vertical housings.

5. The apparatus as recited in claim 1 said vertical rods have positioning slots positioned at set intervals.

6. The apparatus as recited in claim 1 said vertical rods have positioning slots positioned at set intervals and where the locking means lock in to the positioning slots.

7. The apparatus as recited in claim 1 using the dual pillows having the rail assembly move up and down the vertical rods and the rail assembly move left and right along the horizontal rods.

8. The apparatus as recited in claim 1 where said apparatus has handles.

9. The apparatus as recited in claim 8 said handles are connected to the two dual pillow blocks.

10. The apparatus as recited in claim 8 having said handles covered in soft grip material.

11. The apparatus as recited in claim 1 having said vertical rods has mounting brackets at the top end of said rods that secures the apparatus to a roof.

12. The apparatus as recited in claim 1 having a work plank that is connected to and is between the left rod and right rod with a locking means.

13. The apparatus as recited in claim 1, further comprising:

said rail assembly has having multiple shingle brackets that connect the top and bottom of the rail assembly to the horizontal rods providing stability.

14. The apparatus as recited in claim 1, further comprising:

where rail assembly moves up and down both of the vertical rods and the vertical rods move left and right along the horizontal rods.

15. A method comprising:

using the apparatus according to claim 1 to line up shingles to be installed and moving to a new position once a row of shingles is installed.

16. A method according to claim 15 comprising:

where the shingles are lined up with the rail assembly.

* * * * *